US011125015B2

(12) United States Patent
Goudreault

(10) Patent No.: US 11,125,015 B2
(45) Date of Patent: Sep. 21, 2021

(54) LADDER ANCHOR APPARATUS

(71) Applicant: Sebastien Goudreault, Alton (CA)

(72) Inventor: Sebastien Goudreault, Alton (CA)

( * ) Notice: Subject to any disclaimer, the term of this patent is extended or adjusted under 35 U.S.C. 154(b) by 85 days.

(21) Appl. No.: 16/731,707

(22) Filed: Dec. 31, 2019

(65) Prior Publication Data

US 2021/0198947 A1 Jul. 1, 2021

(51) Int. Cl.

| | |
|---|---|
| ***E06C 7/46*** | (2006.01) |
| ***E06C 7/18*** | (2006.01) |
| ***E06C 7/06*** | (2006.01) |

(52) U.S. Cl.

CPC ..... *E06C 7/46* (2013.01); *E06C 7/06* (2013.01); *E06C 7/188* (2013.01)

(58) Field of Classification Search

CPC ..... E06C 7/46; E06C 7/06; E06C 7/188
USPC ..... 182/107
See application file for complete search history.

(56) References Cited

U.S. PATENT DOCUMENTS

| | | | | |
|---|---|---|---|---|
| 1,676,197 | A * | 7/1928 | Marrinan | E02D 5/80 52/156 |
| 1,972,064 | A * | 8/1934 | Moushon | E06C 7/14 248/210 |
| 2,523,535 | A | 9/1950 | Little | |
| 4,007,807 | A | 2/1977 | Pogwizd | |
| 5,918,669 | A | 7/1999 | Morris | |
| 5,918,698 | A * | 7/1999 | Lunn | E06C 7/423 182/107 |
| 6,089,350 | A | 7/2000 | Hankins | |
| 7,743,886 | B2 | 6/2010 | Feemster | |
| D627,902 | S | 11/2010 | Reynolds | |
| 8,464,834 | B2 | 6/2013 | Blazin | |
| 9,084,655 | B2 | 7/2015 | Sahoo | |
| 2007/0289812 | A1* | 12/2007 | Feemster | E06C 7/46 182/107 |
| 2009/0178886 | A1 | 7/2009 | Joyner | |
| 2013/0001014 | A1* | 1/2013 | Halloran | E06C 7/42 182/107 |

* cited by examiner

*Primary Examiner* — Alvin C Chin-Shue

(57) ABSTRACT

A ladder anchor apparatus for securing a ladder in place includes a pair of arms each having a straight portion and a hooked portion. Each of the arms has a pivot aperture. The pair of arms is configured to be selectively engageable within a pair of ladder holes of a pair of legs of a ladder. A hollow pivot rod is coupled to the pair of arms and extends through the pivot aperture of each arm. The pair of arms is pivotably coupled around the pivot rod. A mounting pin is slidingly engageable through the pivot rod and is configured to be inserted into the ground to secure the apparatus in place. An eye hook and a safety chain are coupled to a left arm of the pair of arms. The safety chain prevents the pair of arms from pivoting open when engaged with the eye hook.

11 Claims, 6 Drawing Sheets

LADDER ANCHOR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ladder safety devices and more particularly pertains to a new ladder safety device for securing a ladder in place.

(2) Description of Related Art Including Information Disclosed Under 37 CFR 1.97 and 1.98

The prior art relates to ladder safety devices.

BRIEF SUMMARY OF THE INVENTION

An embodiment of the disclosure meets the needs presented above by generally comprising a pair of arms each having a proximal end and a distal end. A straight portion extends from the proximal end and a hooked portion extends from the straight portion to the distal end. Each of the arms has a pivot aperture extending therethrough adjacent the proximal end. The distal end of each arm is configured to be selectively engageable within a pair of ladder holes of a pair of legs of a ladder. A hollow pivot rod is coupled to the pair of arms and extends through the pivot aperture of each arm. The pair of arms is pivotably coupled around the pivot rod. A mounting pin is slidingly engageable through the pivot rod and is configured to be inserted into the ground to secure the apparatus in place. An eye hook is coupled to a left arm of the pair of arms. A safety chain is coupled to the pair of arms. A first end of the safety chain is coupled to a right arm of the pair of arms and a second end of the safety chain is selectively engageable with the eye hook. The safety chain prevents the pair of arms from pivoting open when engaged with the eye hook.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
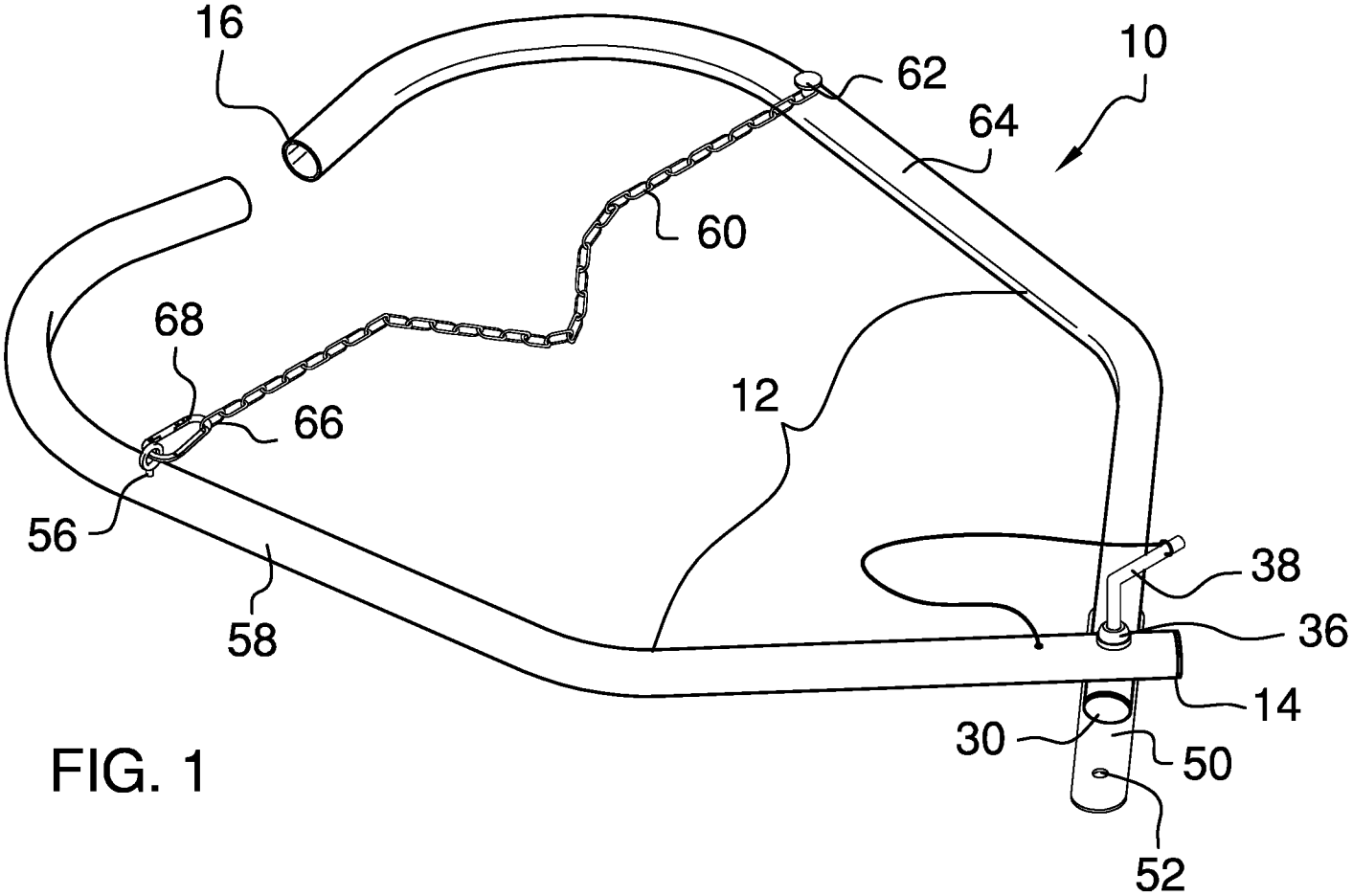
FIG. 1 is an isometric view of a ladder anchor apparatus according to an embodiment of the disclosure.
Figure 2:
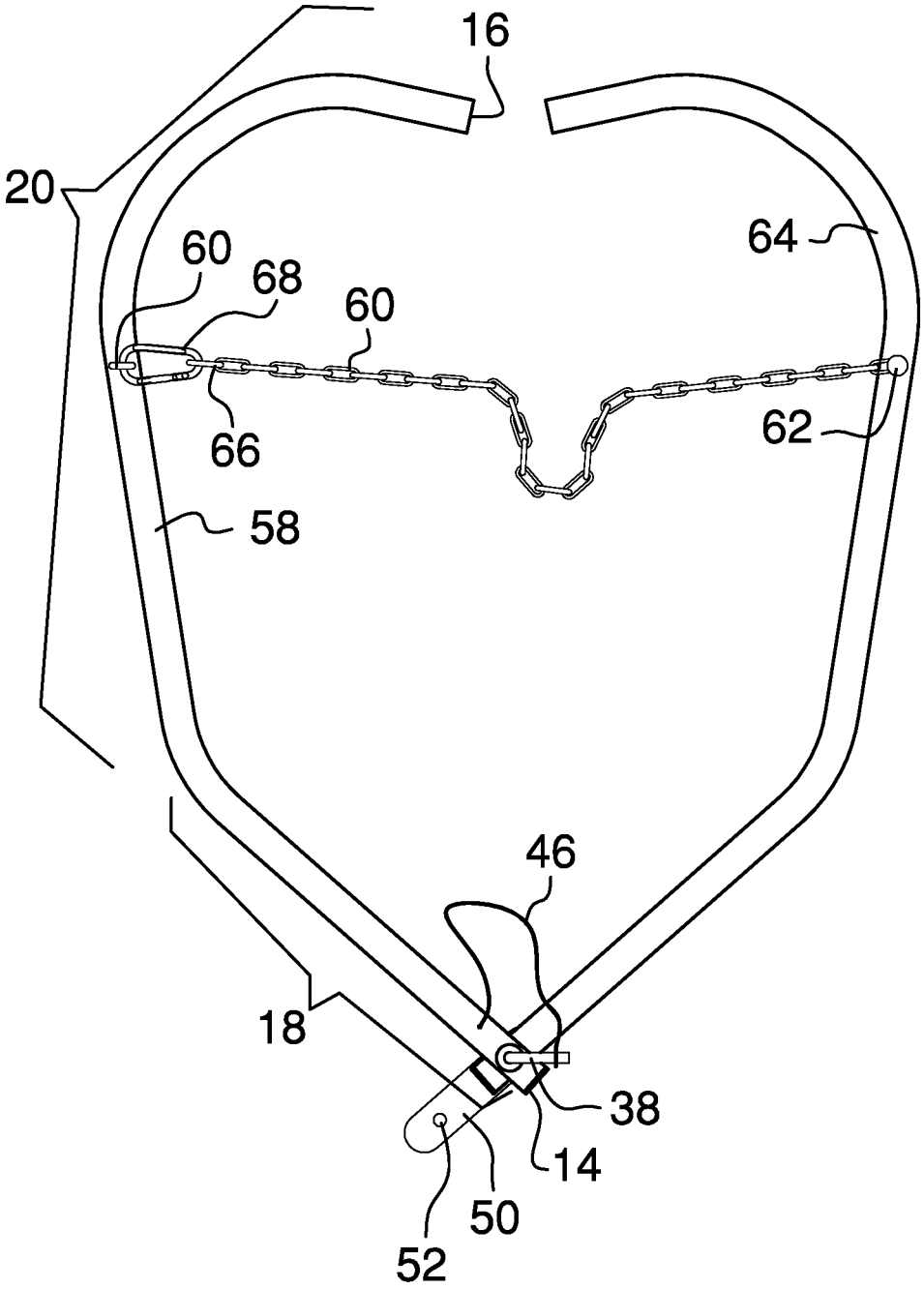
FIG. 2 is a top plan view of an embodiment of the disclosure.
Figure 3:
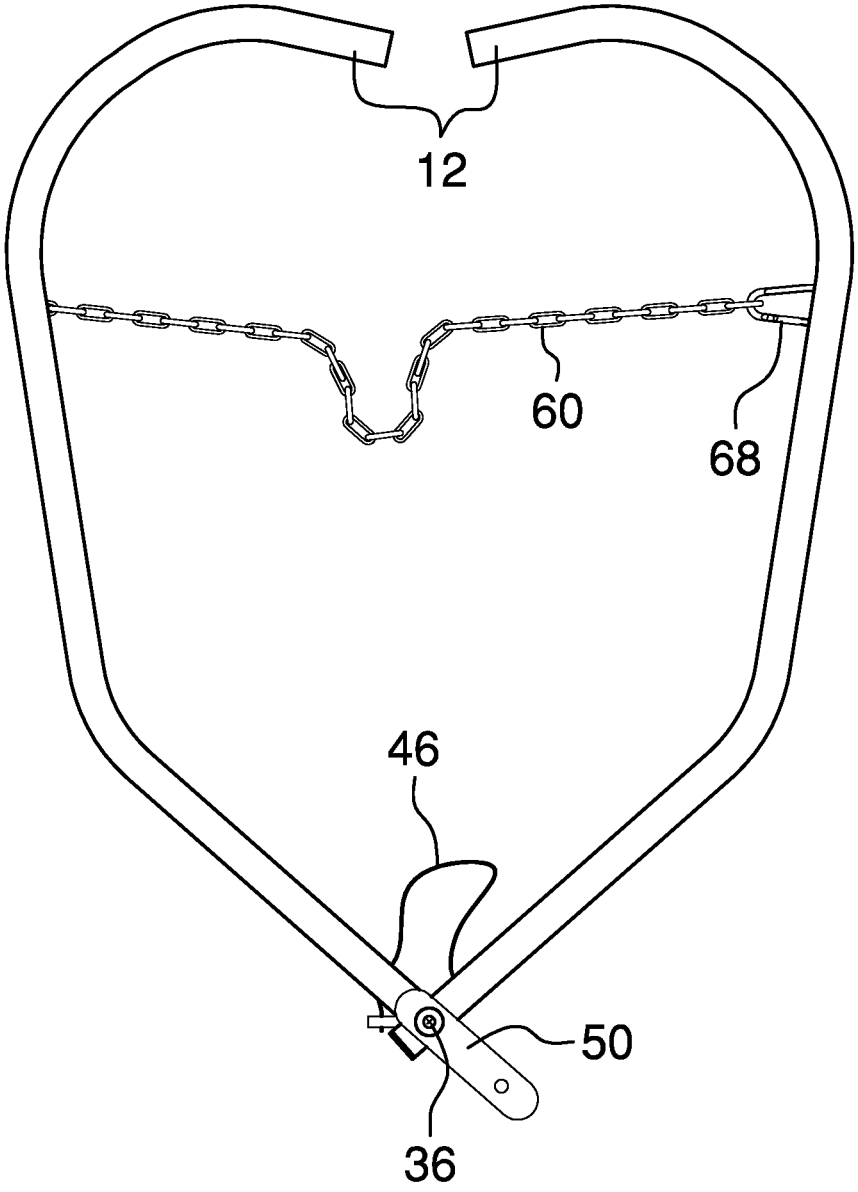
FIG. 3 is a bottom plan view of an embodiment of the disclosure.
Figure 4:
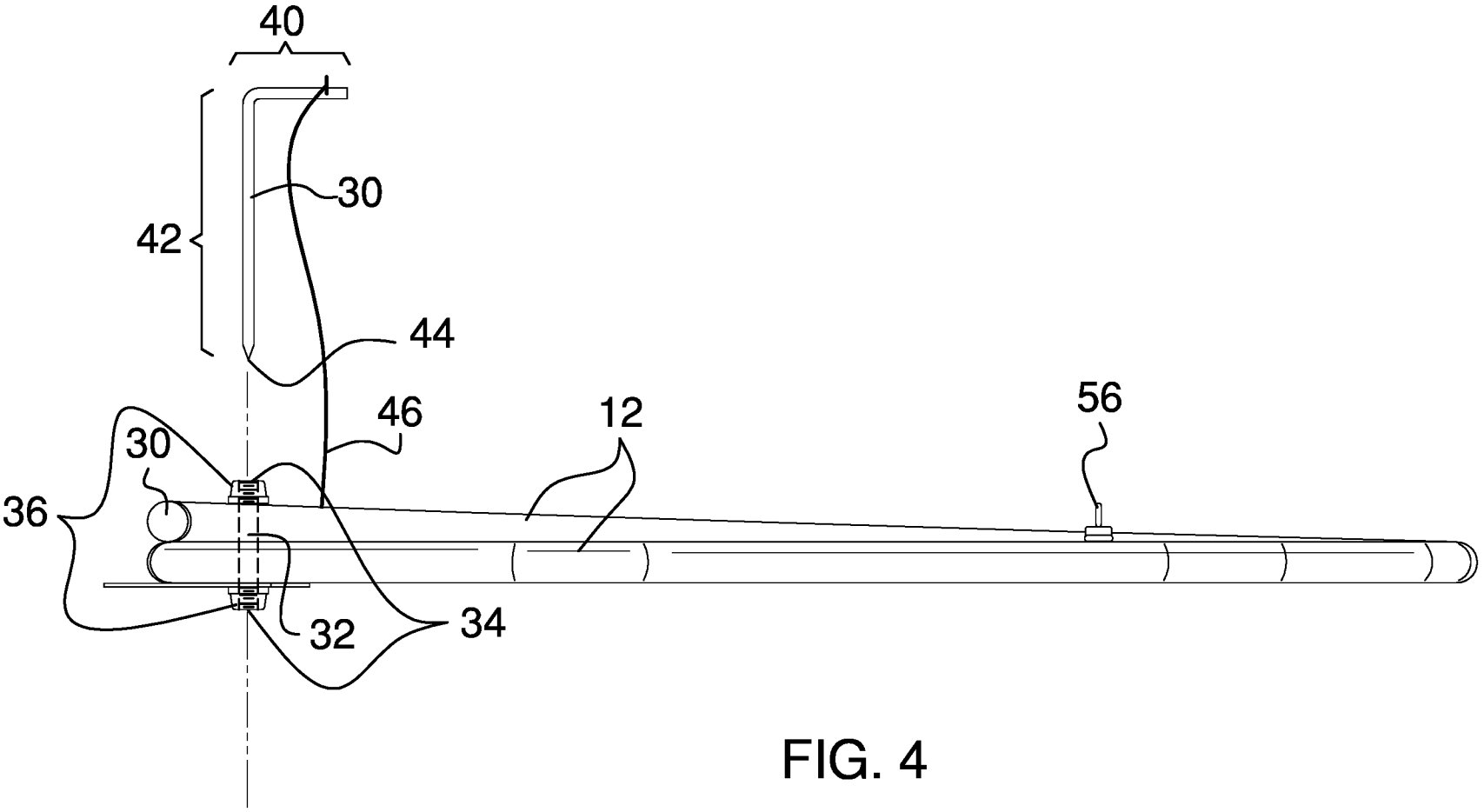
FIG. 4 is a side elevation view of an embodiment of the disclosure.
Figure 5:
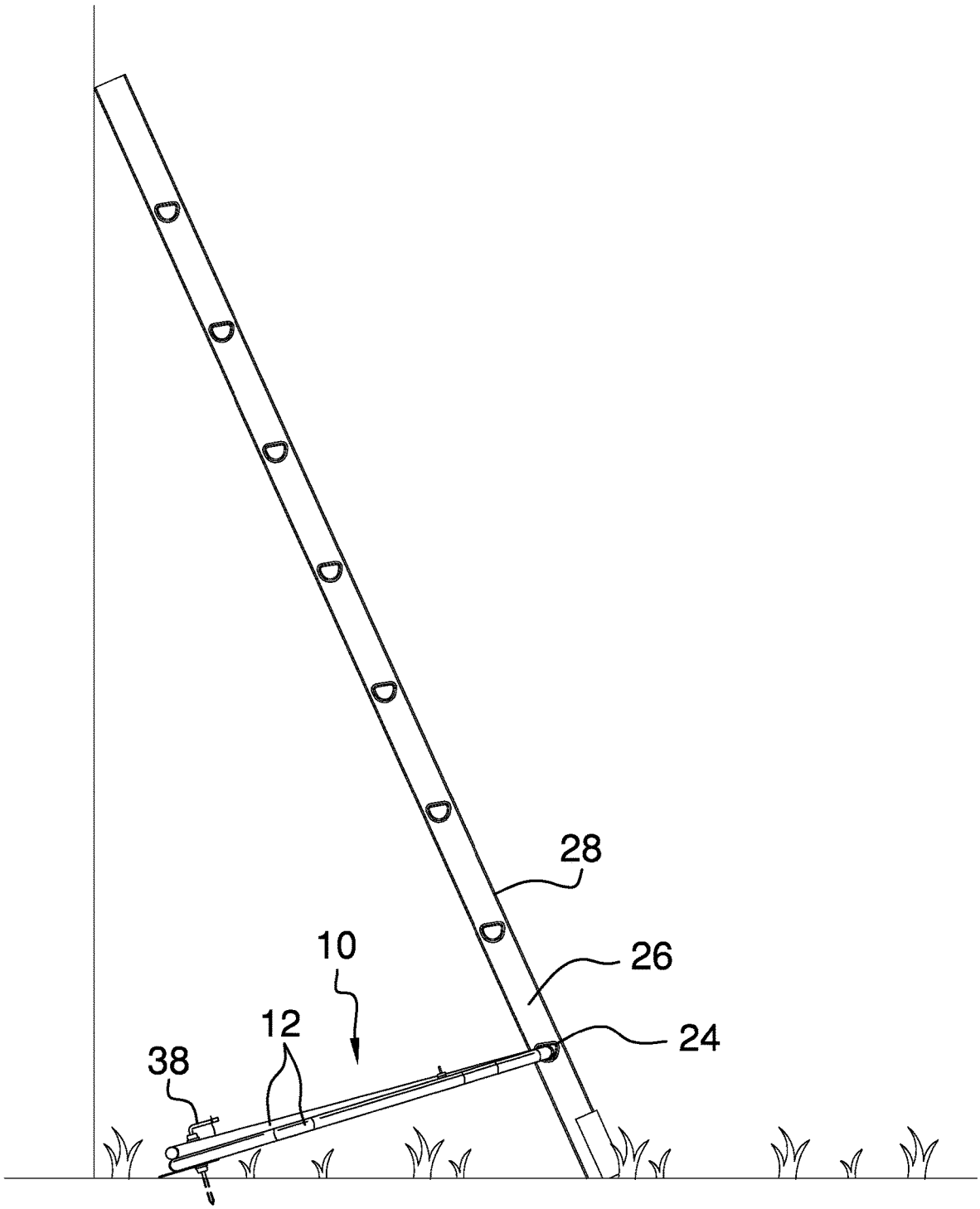
FIG. 5 is an in-use view of an embodiment of the disclosure.
Figure 6:
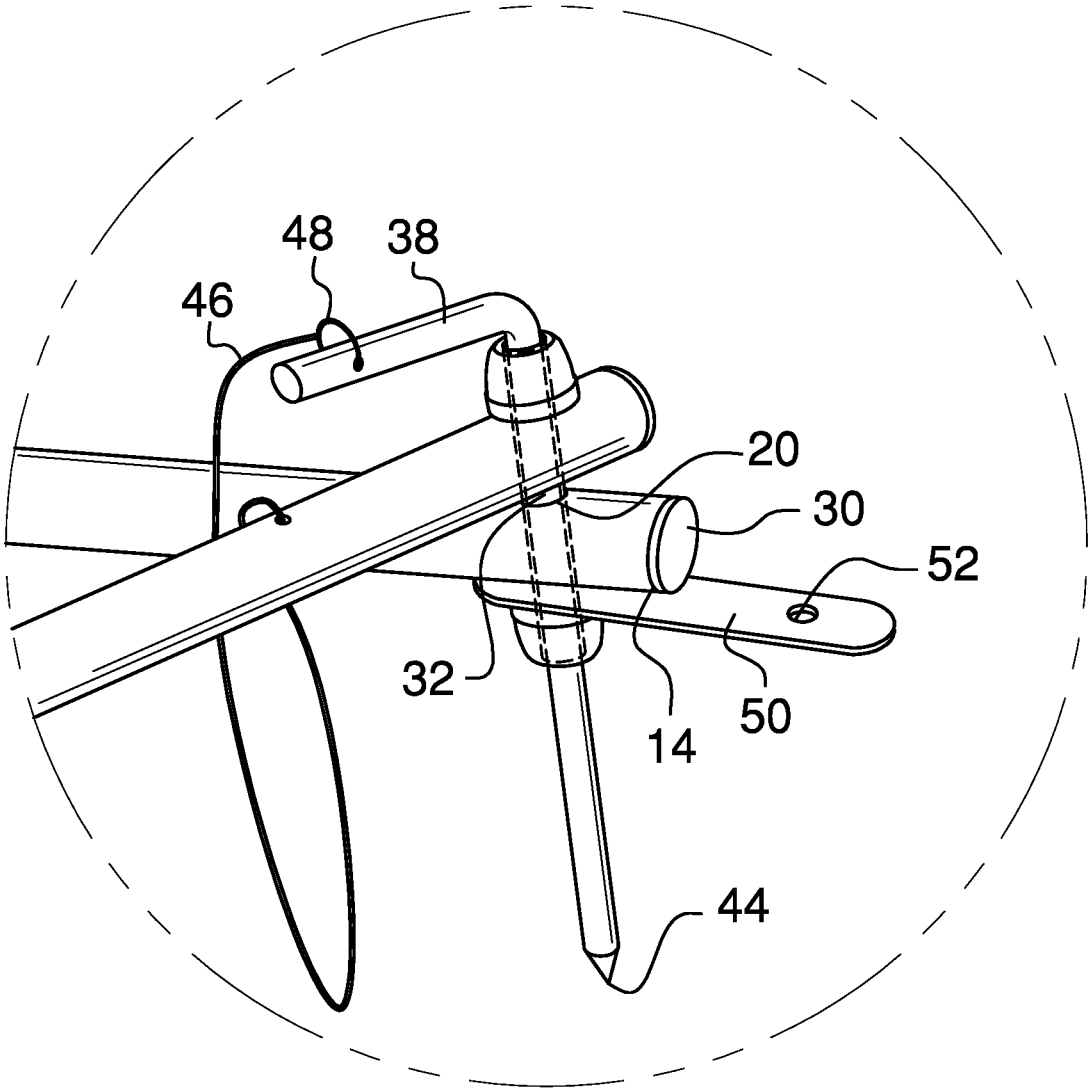
FIG. 6 is a detail view of an embodiment of the disclosure.

With reference now to the drawings, and in particular to FIGS. 1 through 6 thereof, a new ladder safety device embodying the principles and concepts of an embodiment of the disclosure and generally designated by the reference numeral 10 will be described.

As best illustrated in FIGS. 1 through 6, the ladder anchor apparatus 10 generally comprises a pair of arms 12 each having a proximal end 14 and a distal end 16. A straight portion 18 extends from the proximal end 14 and a hooked portion 20 extends at an obtuse angle from the straight portion 18 to the distal end 16. Each of the arms 12 has a pivot aperture 22 extending therethrough adjacent the proximal end 14. The distal end 16 of each arm 12 is configured to be selectively engageable within a pair of ladder holes 24 of a pair of legs 26 of a ladder 28. Each arm 12 may be tubular and may have a cap 30 coupled within the proximal end 14. A hollow pivot rod 32 is coupled to the pair of arms 12 and extends through the pivot aperture 22 of each arm 12. The pivot rod 32 has a pair of threaded ends 34 extending past the pair of arms 12 and a pair of locking nuts 36 coupled to the pair of threaded ends 34. The pair of arms 12 is pivotably coupled around the pivot rod 32.

A mounting pin 38 is L-shaped and comprises a handle portion 40 and a spike portion 42. A bottom end 44 of the spike portion 42 is pointed. The spike portion 42 is slidingly engageable through the pivot rod 32 and is configured to be inserted into the ground to secure the apparatus 10 in place. A length of the spike portion 42 is at least 2.5 times greater than a length of the handle portion 40. A tether 46 is coupled between the pair of arms 12 and the mounting pin 38. The tether 46 has a tether ring 48 coupled to the handle portion 40. The tether 46 prevents the mounting pin 38 from being lost or misplaced when not in use. A mounting plate 50 is coupled to the pivot rod 32. The mounting plate 50 is obround and has a mounting aperture 52 configured to receive a fastener to fix the apparatus 10 to a hard surface such as a deck when the mounting pin 38 cannot be used. An eye hook 56 is coupled to a left arm 58 of the pair of arms 12. A safety chain 60 is coupled to the pair of arms 12. A first end 62 of the safety chain 60 is coupled to a right arm 64 of the pair of arms 12 and a second end 66 of the safety chain 60 has a carabiner 68. The carabiner 68 is selectively engageable with the eye hook 56. The safety chain 60 prevents the pair of arms 12 from pivoting open when engaged with the eye hook 56. A length of the safety chain 60 prevents the distal end 16 of the pair of arms 12 from disengaging from the ladder 28.

In use, the distal end 16 of each arm 12 of the apparatus 10 is engaged with the pair of ladder holes 24 of the pair of legs 26 of the ladder 28. The spike portion 42 of the mounting pin 38 is inserted through the pivot rod 32 and into the ground to secure the apparatus 10 in place. The mounting aperture 52 of the mounting plate 50 receives the fastener to fix the apparatus 10 to a hard surface when the mounting pin 38 cannot be used. The safety chain 60 is coupled to the pair of arms 12 to prevent the pair of arms 12 from pivoting open.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder anchor apparatus comprising:

a pair of arms, each arm having a proximal end and a distal end, a straight portion extending from the proximal end and a hooked portion extending from the straight portion to the distal end, each of the arms having a pivot aperture extending therethrough adjacent the proximal end, the distal end of each arm being configured to be selectively engageable within a pair of ladder holes of a pair of legs of a ladder;

a hollow pivot rod coupled to the pair of arms, the pivot rod extending through the pivot aperture of each arm, the pair of arms being pivotably coupled around the pivot rod;

a mounting pin, the mounting pin being slidingly engageable through the pivot rod and configured to be inserted into the ground to secure the apparatus in place;

an eye hook coupled to the pair of arms, the eye hook being coupled to a left arm of the pair of arms; and a safety chain coupled to the pair of arms, a first end of the safety chain being coupled to a right arm of the pair of arms and a second end of the safety chain being selectively engageable with the eye hook, the safety chain preventing the pair of arms from pivoting open when engaged with the eye hook.

2. The ladder anchor apparatus of claim 1 further comprising a mounting plate coupled to the pivot rod, the mounting plate having a mounting aperture configured to receive a fastener to fix the apparatus to a hard surface such as a deck.

3. The ladder anchor apparatus of claim 2 further comprising the mounting plate being obround.

4. The ladder anchor apparatus of claim 1 further comprising the mounting pin being L-shaped and comprising a handle portion and a spike portion, a bottom end of the spike portion being pointed.

5. The ladder anchor apparatus of claim 4 further comprising a length of the spike portion being at least 2.5 times greater than a length of the handle portion.

6. The ladder anchor apparatus of claim 1 further comprising a tether coupled between the pair of arms and the mounting pin, the tether having a tether ring coupled to the handle portion.

7. The ladder anchor apparatus of claim 1 further comprising the pivot rod having a pair of threaded ends extending past the pair of arms and a pair of locking nuts coupled to the pair of threaded ends.

8. The ladder anchor apparatus of claim 1 further comprising the hooked portion extending at an obtuse angle from the straight portion.

9. The ladder anchor apparatus of claim 1 further comprising the second end of the safety chain having a carabiner.

10. A ladder anchor apparatus comprising:

a pair of arms, each arm having a proximal end and a distal end, a straight portion extending from the proximal end and a hooked portion extending at an obtuse angle from the straight portion to the distal end, each of the arms having a pivot aperture extending therethrough adjacent the proximal end, the distal end of each arm being configured to be selectively engageable within a pair of ladder holes of a pair of legs of a ladder;

a hollow pivot rod coupled to the pair of arms, the pivot rod extending through the pivot aperture of each arm, the pivot rod having a pair of threaded ends extending past the pair of arms and a pair of locking nuts coupled to the pair of threaded ends, the pair of arms being pivotably coupled around the pivot rod;

a mounting pin, the mounting pin being L-shaped and comprising a handle portion and a spike portion, a bottom end of the spike portion being pointed, the spike portion being slidingly engageable through the pivot rod and configured to be inserted into the ground to secure the apparatus in place, a length of the spike portion being at least 2.5 times greater than a length of the handle portion;

a tether coupled between the pair of arms and the mounting pin, the tether having a tether ring coupled to the handle portion;

a mounting plate coupled to the pivot rod, the mounting plate being obround and having a mounting aperture configured to receive a fastener to fix the apparatus to a hard surface such as a deck;

an eye hook coupled to the pair of arms, the eye hook being coupled to a left arm of the pair of arms; and a safety chain coupled to the pair of arms, a first end of the safety chain being coupled to a right arm of the pair of arms and a second end of the safety chain having a carabiner, the carabiner being selectively engageable with the eye hook, the safety chain preventing the pair of arms from pivoting open when engaged with the eye hook.

11. A ladder and ladder anchor apparatus combination comprising:

a ladder, the ladder having a pair of legs;

a pair of arms, each arm having a proximal end and a distal end, a straight portion extending from the proximal end and a hooked portion extending at an obtuse angle from the straight portion to the distal end, each of the arms having a pivot aperture extending therethrough adjacent the proximal end, the distal end of each arm being configured to be selectively engageable within a pair of ladder holes of the pair of legs of the ladder;

a hollow pivot rod coupled to the pair of arms, the pivot rod extending through the pivot aperture of each arm, the pivot rod having a pair of threaded ends extending past the pair of arms and a pair of locking nuts coupled to the pair of threaded ends, the pair of arms being pivotably coupled around the pivot rod;

a mounting pin, the mounting pin being L-shaped and comprising a handle portion and a spike portion, a bottom end of the spike portion being pointed, the spike portion being slidingly engageable through the pivot rod and configured to be inserted into the ground to secure the apparatus in place, a length of the spike portion being at least 2.5 times greater than a length of the handle portion;

a tether coupled between the pair of arms and the mounting pin, the tether having a tether ring coupled to the handle portion;

a mounting plate coupled to the pivot rod, the mounting plate being obround and having a mounting aperture configured to receive a fastener to fix the apparatus to a hard surface such as a deck;

an eye hook coupled to the pair of arms, the eye hook being coupled to a left arm of the pair of arms; and a safety chain coupled to the pair of arms, a first end of the safety chain being coupled to a right arm of the pair of arms and a second end of the safety chain having a carabiner, the carabiner being selectively engageable with the eye hook, the safety chain preventing the pair of arms from pivoting open when engaged with the eye hook.

* * * * *